US008037688B2

(12) United States Patent
Hagen et al.

(10) Patent No.: US 8,037,688 B2
(45) Date of Patent: Oct. 18, 2011

(54) METHOD FOR CONTROL OF THERMOACOUSTIC INSTABILITIES IN A COMBUSTOR

(75) Inventors: Gregory S. Hagen, Glastonbury, CT (US); Andrzej Banaszuk, Simsbury, CT (US); Prashant G. Mehta, Urbana, IL (US); Jeffrey M. Cohen, Hebron, CT (US); William Proscia, Marlborough, CT (US)

(73) Assignee: United Technologies Corporation, Hartford, CT (US)

( * ) Notice: Subject to any disclaimer, the term of this patent is extended or adjusted under 35 U.S.C. 154(b) by 1034 days.

(21) Appl. No.: 11/527,225

(22) Filed: Sep. 26, 2006

(65) Prior Publication Data

US 2008/0072605 A1 Mar. 27, 2008

(51) Int. Cl.
*F02C 1/00* (2006.01)
*F02G 3/00* (2006.01)

(52) U.S. Cl. ..... 60/733; 60/739

(58) Field of Classification Search ..... 60/733, 60/741, 734, 739, 776
See application file for complete search history.

(56) References Cited

U.S. PATENT DOCUMENTS

| | | | | |
|---|---|---|---|---|
| 2,536,440 | A | | 1/1951 | Greenland |
| 2,664,910 | A | | 1/1954 | Boyd et al. |
| 2,700,394 | A | | 1/1955 | Jay |
| 2,731,976 | A | | 1/1956 | Orent et al. |
| 2,782,739 | A | | 2/1957 | Freer |
| 2,832,368 | A | | 4/1958 | Freer |
| 4,226,365 | A | | 10/1980 | Norris et al. |
| 5,003,771 | A | * | 4/1991 | Kester et al. ..... 60/243 |
| 5,131,426 | A | | 7/1992 | Schultz |
| 5,491,970 | A | * | 2/1996 | Davis et al. ..... 60/776 |
| 5,528,897 | A | * | 6/1996 | Halin ..... 60/39.094 |
| 5,694,967 | A | | 12/1997 | Schultz |
| 5,941,074 | A | | 8/1999 | Schultz |
| 6,092,546 | A | | 7/2000 | Lebrun et al. |
| 6,311,716 | B1 | | 11/2001 | Jones |
| 2006/0101814 | A1 | * | 5/2006 | Saitoh et al. ..... 60/377 |
| 2007/0039329 | A1 | | 2/2007 | Abreu et al. |

FOREIGN PATENT DOCUMENTS

| | | | |
|---|---|---|---|
| EP | 1331448 | A2 | 7/2003 |
| EP | 1555484 | A2 | 7/2005 |
| WO | W09812478 | A1 | 3/1998 |
| WO | W02006082210 | A1 | 8/2006 |

OTHER PUBLICATIONS

Bonnell, J., et al., "Combustion Instability in Turbojet and Turbofan Augmentors," from AIAA/SAE 7th Propulsion Joint Specialist Conference, Jun. 14-18, 1971, pp. 1-8.

(Continued)

*Primary Examiner* — Michael Cuff
*Assistant Examiner* — Andrew Nguyen
(74) *Attorney, Agent, or Firm* — Kinney & Lange, P.A.

(57) ABSTRACT

A method for controlling a temperature distribution within a combustor having a plurality of chamber sections comprising controlling a fuel-to-air ratio in the chamber sections. At least two chamber sections have different fuel-to-air ratios to create a non-uniform temperature distribution within the combustor to reduce thermoacoustic instabilities.

24 Claims, 10 Drawing Sheets

OTHER PUBLICATIONS

Candel, S., "Combustion Dynamics and Control Progress and Challenges," from Proceedings of the Combustion Institute, vol. 29, 2002, pp. 1-28. Lieuwen, T., "Modeling Premixed Combustion—Acoustic Wave Interactions: A Review," from Journal of Propulsion and Power, vol. 19, No. 5, Sep.-Oct. 2003, pp. 765-781.

Hibshman, J.R., et al., "Active Control of Combustion Instability in a Liquid-Fueled Sector Combustor," from ASME Paper 99-GT-215: Presented at the 44th ASME Gas Turbine and Aeroengine Technical Congress, Indianapolis, IN, Jun. 7-10, 1999.

Cohen, J.M., et al., "Factors Affecting the Control of Unstable Combustors," from Journal of Propulsion and Power, vol. 19, No. 5, Sep.-Oct. 2003, pp. 811-821.

Banaszuk, A., et al., "Linear and Nonlinear Analysis of Controlled Combustion Processes—Part II: Nonlinear Analysis," pp. 1-7.

Banaszuk, A., et al., "Linear and Nonlinear Analysis of Controlled Combustion Processes—Part II: Nonlinear Analysis," IEEE Conference on Control Applications, Aug. 1999, pp. 206-212.

The European Search Report of counterpart European Application No. 07253776 filed Sep. 24, 2007.

* cited by examiner

METHOD FOR CONTROL OF THERMOACOUSTIC INSTABILITIES IN A COMBUSTOR

CROSS-REFERENCE TO RELATED APPLICATION(S)

The following application is filed on the same day as the following co-pending application: "FLOW DIVIDER VALVE FOR CONTROLLING A COMBUSTOR TEMPERATURE DISTRIBUTION" by inventors Jeffrey M. Cohen, James B. Hoke, and Stuart Kozola (application Ser. No. 11/527,431). The above application is herein incorporated by reference in its entirety.

BACKGROUND OF THE INVENTION

The present invention relates generally to gas turbine engines. More particularly, the present invention relates to a method for controlling thermoacoustic instabilities in a combustor.

Thermoacoustic instabilities arise in gas turbine and aero-engines when acoustic modes couple with unsteady heat released due to combustion in a positive feedback loop. These instabilities can lead to large pressure oscillations inside the combustor cavity, thereby affecting its stable operation and potentially causing structural damage to the combustor components. Two particular examples of thermoacoustic instabilities in annular combustors are the "screech" instability in the afterburner and the "howl" instability in the primary combustion chamber.

Prior art approaches for control of thermoacoustic instabilities typically utilized passive liners or tuned resonators configured to damp the acoustic mode. However, these solutions suffer from several disadvantages. In particular, they introduce additional weight and may be expensive to implement. In addition, resonators are effective only over a limited range of frequencies and become ineffective if frequency of the instability changes because of, for example, changes in operating conditions. These passive devices have to be cooled, which may detrimentally affect the efficiency of the engine. Finally, effective tuned resonator design requires a prior knowledge of the frequency of instability.

Active combustion control has also been considered as an approach for control of thermoacoustic instabilities. Active approaches usually require an accurate mathematical model of the thermoacoustic dynamics for control design. However, on account of complex combustion physics, the exact physical mechanism underlying the initiation and sustenance of instabilities such as screech typically is not understood. Furthermore, there are implementation issues such as lack of suitable bandwidth fuel valves that are needed for active control.

The thermoacoustic instabilities typically appear only during a small portion of an aero-engine's flight envelope or operating conditions in the case of land-based combustors. Thus, passive dampers and active control systems are useful to help control thermoacoustic oscillations only over a small portion of operating conditions and have no useful function at nominal operating conditions. Furthermore, they negatively affect weight and performance of the engine at the operating conditions where the instability is not present.

BRIEF SUMMARY OF THE INVENTION

The present invention is a method for controlling a temperature distribution within a combustor having a plurality of chamber sections comprising controlling a fuel-to-air ratio in the chamber sections. At least two chamber sections have different fuel-to-air ratios to create a non-uniform temperature distribution within the combustor to reduce thermoacoustic instabilities.

DETAILED DESCRIPTION

Figure 1:
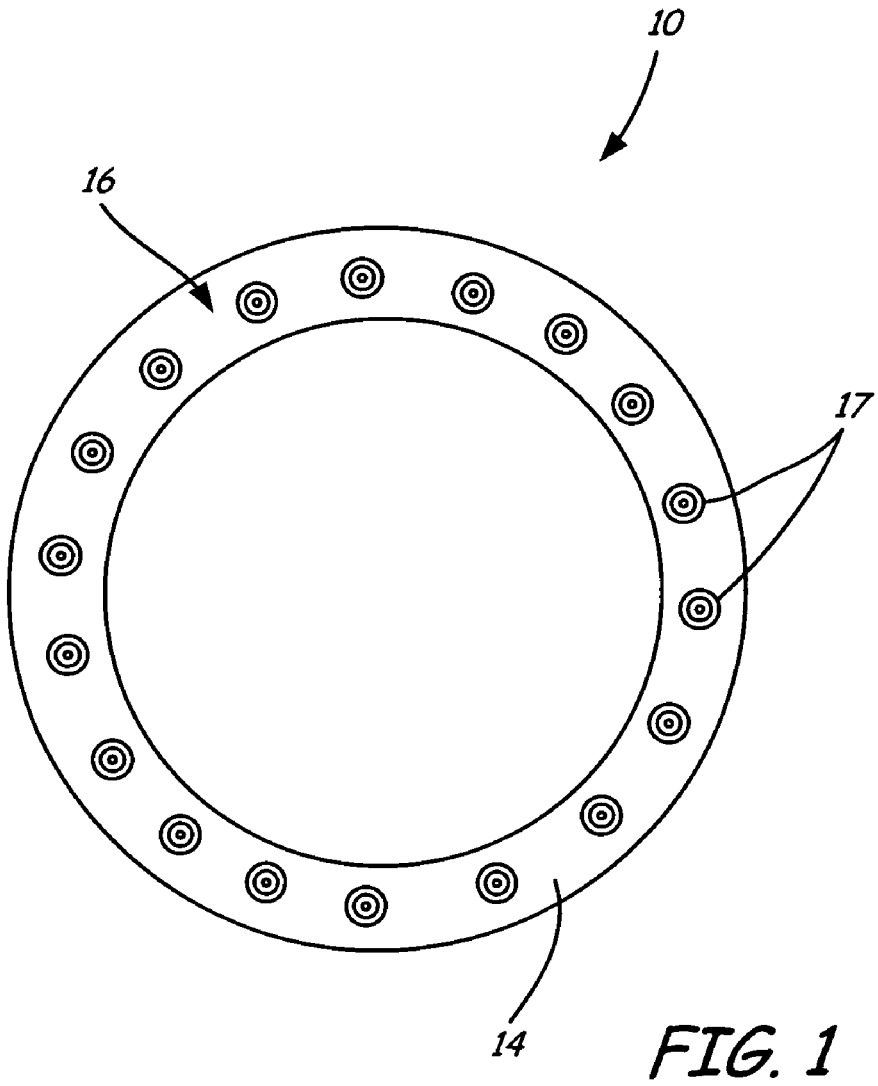
FIG. 1 is a diagram illustrating a combustor of an aircraft engine.

FIG. 1 is a diagram illustrating an end view of an annular combustor 10 of an aircraft engine having bulkhead section 14. Attached to bulkhead section 14 is fuel manifold assembly 16, which includes a plurality of fuel nozzles 17 (as well as additional components not visible in FIG. 1). It should be noted that an annular combustor 10 is described for purposes of example and not for limitation, and that other types of combustors, such as cylindrical combustors, are also within the intended scope of the present invention.

Combustor 10 is configured to burn a mixture of fuel and air to produce combustion gases. These combustion gases are then delivered to a turbine located downstream of combustor 10 at a temperature which will not exceed an allowable limit at the turbine inlet. Combustor 10, within a limited space, must add sufficient heat and energy to the gases passing through the engine to accelerate their mass enough to produce the desired power for the turbine and thrust for the engine. In addition to such things as high combustion efficiency and minimum pressure loss, another important criterion in burner and combustion chamber design is the ability to prevent or limit thermoacoustic instabilities within the combustor.

Figure 2:
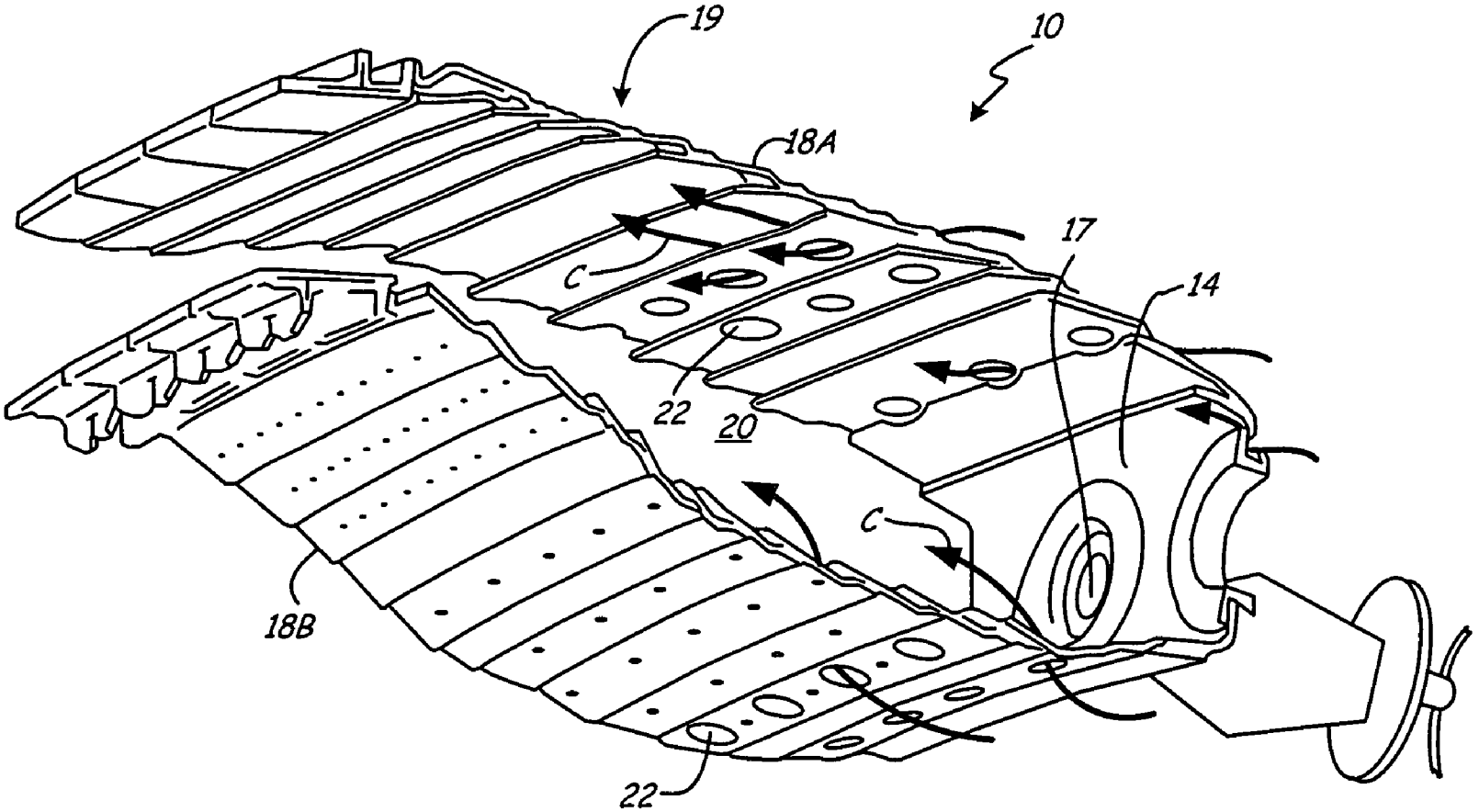
FIG. 2 is a cross-sectional view of a portion of the combustor.

FIG. 2 is a cross-sectional view of combustor 10, which further includes outer chamber section 18A and inner chamber section 18B. As shown in FIG. 2, when assembled, outer chamber section 18A and inner chamber section 18B create an annular combustion chamber 19, which includes a pocket 20 where the combustion takes place. Outer chamber section 18A and inner chamber section 18B consist of continuous, circular shrouds configured to be positioned around the outside of a compressor drive shaft housing of the aircraft engine. A plurality of holes 22 in outer and inner chamber sections 18A and 18B allow secondary air C to enter combustion chamber 19, thereby keeping the burner flame away from outer and inner chamber sections 18A and 18B.

Figure 3:
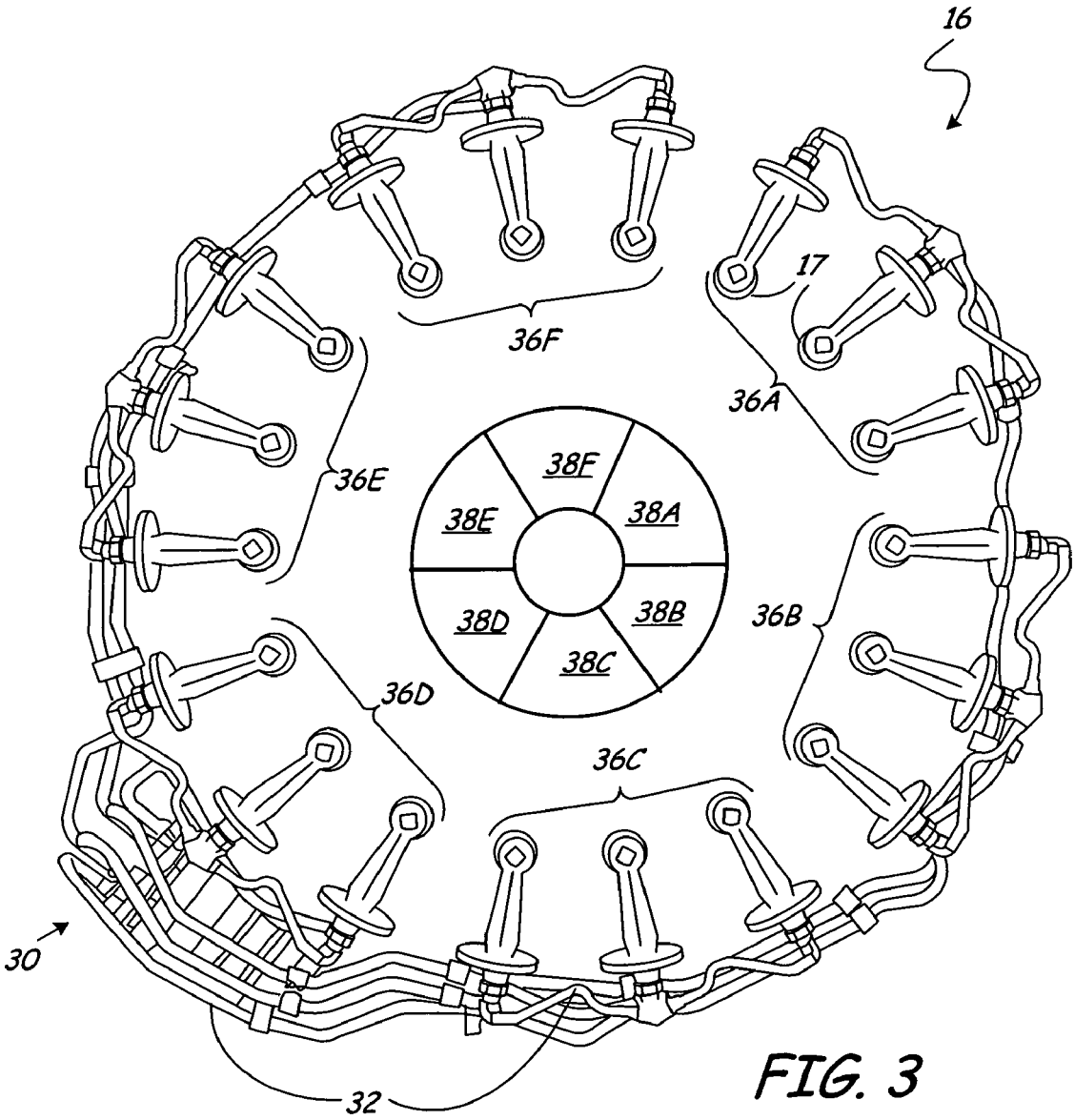
FIG. 3 is a diagram illustrating a fuel manifold.

FIG. 3 is a diagram illustrating fuel manifold assembly 16, which includes fuel nozzles 17, flow divider valve 30, and a plurality of fuel lines 32. As shown in FIG. 3, fuel nozzles 17 are separated into groups and form first fuel zone 36A, second fuel zone 36B, third fuel zone 36C, fourth fuel zone 36D, fifth fuel zone 36E, and sixth fuel zone 36F. Fuel zones 36A-36F are configured to control combustion within and temperature of corresponding chamber sections 38A-38F of combustion chamber 19, which is represented by the doughnut-shaped region in the middle of fuel manifold assembly 16. It should be understood that the doughnut-shaped region is a generic representation of the combustion chamber sections that correspond with the fuel zones, and is shown merely for purposes of explanation.

It is important to note that although the embodiment in FIG. 3 depicts fuel manifold assembly 16 having six fuel zones, fuel manifolds having any number of fuel zones are possible. Furthermore, although fuel zones 36A-36F are shown as having three fuel nozzles 17 per zone, fuel zones having any number of fuel nozzles 17 are contemplated.

In one embodiment of a combustor 10, flow divider valve 30 is configured to divide a single stream of fuel from a fuel source (not shown) into a plurality of fuel streams equal to the number of fuel zones, which equals six in the embodiment shown. Each of fuel zones 36A-36F is fed by one of fuel lines 32, where a manifold dedicated to each fuel zone further apportions the fuel flow between each fuel nozzle 17 in the fuel zone. In this embodiment, flow divider 30 may be configured to provide a desired combustor temperature distribution by controlling the amount of fuel distributed to each fuel zone at any given point in time. By controlling the amount of fuel distributed to each of fuel zones 36A-36F, and thus the temperature within corresponding chamber sections 38A-38F, flow divider valve 30 may help alleviate, among other things, thermoacoustic instabilities caused by the interaction between the acoustics of combustion chamber 19 and the combustion process itself.

The term "thermoacoustic instability" may refer to a wide range of oscillatory phenomena observable in combustion systems. Thermoacoustic instabilities in gas-turbine combustion chambers typically arise due to the fact that the combustion process leads to a localized, unsteady heat release with high energy. These oscillatory phenomena in combustion chambers result from the coupling of the unsteady heat release resulting from the combustion process with acoustic waves in the combustion chamber, which create pressure fluctuations with large amplitudes at various frequencies within the chamber. The instability frequencies are generally associated with the geometry of the combustion chamber and may be influenced by interactions between the combustion chamber and the flow field.

Thermoacoustic instability is commonly referred to as "tonal noise." Not only is tonal noise objectionable to those individuals in and around an aircraft, but vibrations resulting from the tonal noise may also cause damage to portions of the aircraft, including engine components. Thus, suppressing thermoacoustic instabilities in a system is desirable not only to decrease the resulting audible annoyances, but also to increase system performance and improve engine life. The present invention provides a method for controlling thermoacoustic instabilities in a combustor by controlling the temperature field, and thus the speed of sound, within the combustor.

Figure 4:
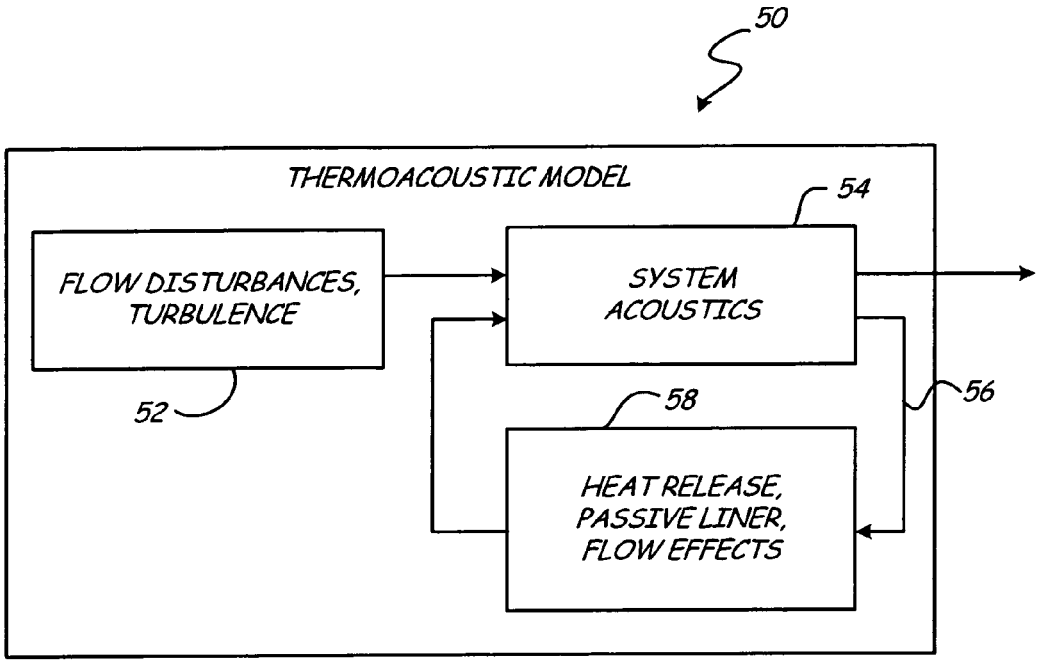
FIG. 4 is a block diagram illustrating how combustor acoustics affect a combustion process.

FIG. 4 is a block diagram of a thermoacoustic model 50 illustrating how combustor acoustics affect the combustion process. Thermoacoustic instabilities in annular combustors may be modeled as a feedback interconnection of a circumferentially distributed one-dimensional wave equation with feedback on account of such things as heat release, passive liners, and flow effects. The combustion is realized by circumferentially distributed elements, such as flameholders in bluff-body stabilized augmentors and swirlers in swirl stabilized combustion chambers. For purposes of explanation, a model for the heat release feedback is not assumed. Furthermore, for simplicity, it is assumed that the individual flameholders or swirlers are identical. However, the method of the present invention is not limited to identical flameholders or swirlers.

In the absence of any feedback, the $n^{th}$ circumferential mode (which may be denoted by nT) corresponds to two pairs of complex eigenvalues. The corresponding eigenvectors have the physical interpretation of the two counter-rotating waves, one rotating in the clockwise direction, and the other rotating in the counterclockwise direction. Similarly, the nT modes also have clockwise and counterclockwise directions of rotation. For purposes of example, it is assumed that a +1 tangential acoustic wave mode (a 1 T mode) and a −1 tangential acoustic wave mode (also a 1 T mode) represent the counter-rotating waves within combustion chamber 19 throughout the remainder of this disclosure.

In reference to thermoacoustic model 50 of FIG. 4, the combustion process creates flow disturbances and turbulence, as indicated by block 52. The flow disturbances created by the combustion process interact with the system acoustics inherent in combustion chamber 19, which is shown by the arrow pointing from block 52 to block 54. As illustrated in FIG. 4, a feedback loop 56 connects block 54 and block 58 in a continuous, closed loop, which represents system heat release continuously interacting with the system acoustics. The effect of the heat release feedback is to destabilize one or both of the waveform directions by causing their respective eigenvalues to become more unstable.

In general, any heat release feedback may be decomposed as a sum of symmetric and skew-symmetric feedback. As used here, a combustion element is defined as the combustion occurring behind a single flameholder or a single swirl nozzle. Conceptually, the symmetric feedback corresponds to combustion dynamics that have reflection symmetry while the skew-symmetry is a result of local asymmetry in combustion. The symmetric feedback acts on counter-rotating modes similarly, while skew-symmetric feedback stabilizes one rotating mode while destabilizing the counter-rotating mode. The present invention is particularly useful for controlling thermoacoustic instabilities arising from skew-symmetric feedback.

Figure 5:
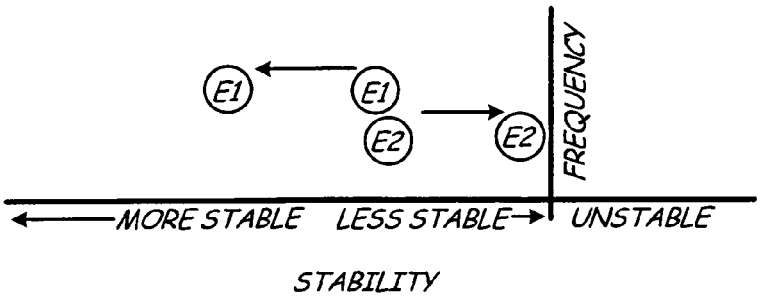
FIG. 5 illustrates how skew-symmetric heat release feedback affects an acoustic mode.

FIG. 5 illustrates the impact of skew-symmetric heat release feedback on the nT modal eigenvalues of the acoustics. In particular, the eigenvalue corresponding to the +1 tangential acoustic wave mode is designated as E1 in FIG. 5, while the eigenvalue corresponding to the −1 tangential acoustic wave mode is designated as E2. As shown in FIG. 5, the skew-symmetric feedback splits eigenvalues E1 and E2, causing one rotating mode to gain damping (i.e., become more stable) while causing the other rotating mode to lose the same amount of damping (i.e., become less stable).

Thermoacoustic instability occurs when the eigenvalue corresponding to the lightly damped direction (less stable wave mode) crosses the imaginary axis into the unstable region in FIG. 5. Even if the eigenvalue does not cross the imaginary axis into the unstable region, presence of a significant amount of turbulent noise together with a lightly damped eigenvalue causes large pressure oscillations. In either case, the resulting spatial waveform corresponds to a wave rotating in the direction consistent with that of the eigenvector of the lightly damped eigenvalue.

The detrimental effect of the skew-symmetric feedback may be reversed using spatial mistuning of the wave (sound) speed by varying the spatial temperature distribution along the azimuthal direction of combustion chamber 19. For nT-mode suppression, the optimal beneficial energy exchange between clockwise and counterclockwise wave modes results from a temperature distribution pattern within combustion chamber 19 that has a 2 nT-mode shape. In particular, the beneficial energy exchange between clockwise and counterclockwise nT modes is proportional to the 2 nT-harmonic component of the mistuning pattern. Thus, in the example described herein where a 1 T mode and a −1 T mode represent the counter-rotating waves within combustion chamber 19, a temperature distribution pattern that has a 2 T-mode shape could be used to reverse the effect of the skew-symmetric feedback. Similarly, if a 2 T mode and a −2 T mode represented the counter-rotating waves within combustion chamber 19, a temperature distribution pattern that has a 4 T-mode shape could be used. Thus, any temperature distribution pattern that has approximately a 2 nT-mode shape is within the intended scope of the present invention.

Figure 6A:
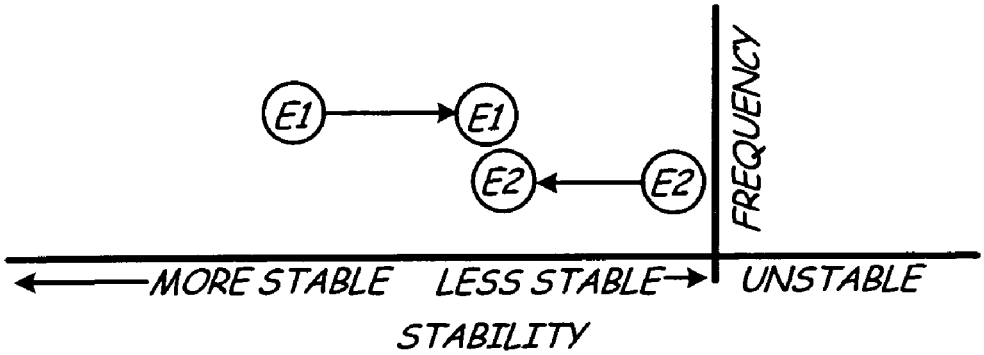
FIG. 6A illustrates the impact of an adaptive spatial fuel distribution method on skew-symmetric heat release feedback.

FIG. 6A illustrates the impact of the method of the present invention on the skew-symmetric heat release feedback. As shown in FIG. 6A, by varying the spatial fuel distribution within fuel zones 36A-36F, and thus the temperature within corresponding combustion chamber sections 38A-38F, variations in sound speed due to the non-uniform temperature distribution cause the eigenvalues to move close to one another, as illustrated by the directions of the arrows in FIG. 6A. Thus, the adaptive spatial fuel distribution within combustion chamber 19 has resulted in an exchange of damping between the two counter-rotating wave modes.

The role of the temperature pattern can also be understood as mistuning of the two nT-rotating directions by introducing spatial variations in sound speed. Localized increase (or decrease) in the fuel delivery along the circumference of a combustion chamber, such as combustion chamber 19, leads to increase (or decrease) in localized temperature that increases (or decreases) the localized sound wave speed. As a general rule of physics, the speed of sound within a combustor is proportional to the square root of the temperature within the combustor. Furthermore, temperature is a function of the fuel to air ratio associated with the combustor. Finally, since it may be presumed that the air is regularly distributed, the fuel to air ratio is a function of local fuel flow. Thus, by changing the distribution of fuel flow to cause more fuel to flow to certain chamber sections and less fuel to others, the speed of sound in chamber sections 38A-38F may be controlled.

Figure 6B:
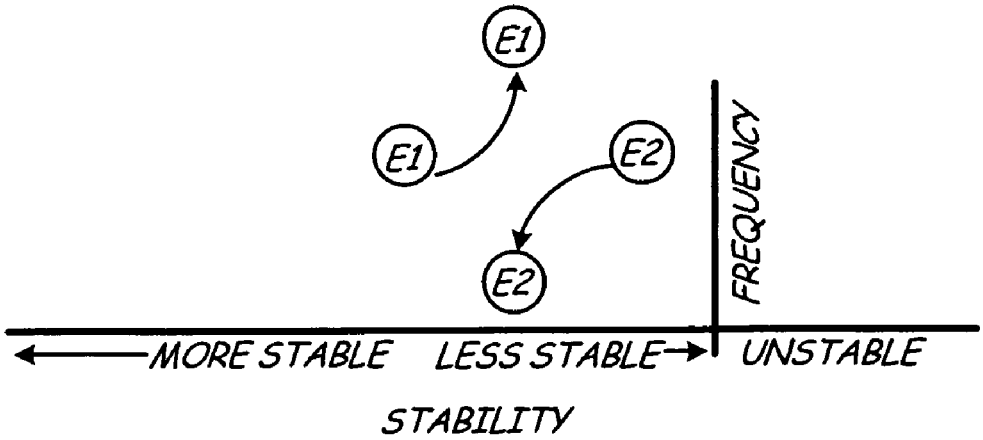
FIG. 6B illustrates the effect of fuel mistuning beyond an optimal amount.

For a given skew-symmetric feedback (i.e., the "split" of eigenvalues illustrated in FIG. 5), there is an optimal amount of fuel variation that reverses the detrimental effect of the skew-symmetric feedback. This optimal amount corresponds to an eigenvalue diagram similar to FIG. 6A where the two 1 T eigenvalues are relatively close to one another. Decreasing the amount of mistuning from the optimal amount causes one of the directions to become lightly damped at the expense of the other. On the other hand, increasing the mistuning beyond the optimal amount causes the two counter-rotating waves to shift in frequency without any additional damping benefit. This phenomenon is illustrated in FIG. 6B. As shown in FIG. 6B, if fuel zones 36A-36F are "mistuned" beyond the optimal amount of fuel variation, the optimal amount of "damping exchange" between the modes is exceeded, and the only effect of the additional fuel variation is to cause a further split in frequency between eigenvalues E1 and E2 as indicated by the directions of the arrows in FIG. 6B. As a result, beyond the optimal amount of fuel mistuning, no further beneficial energy exchange (damping) occurs between the counter-rotating wave modes.

While spatially non-uniform fueling leads to suppression of thermoacoustic instabilities, non-uniform fueling also leads to non-uniform circumferential temperature distribution that can detrimentally affect engine durability. In order to keep temperature within combustion chamber 19 as uniform as possible over the largest portion of the flight envelope or flight operating conditions, the method of the present invention should be used to adjust the fuel distribution profile as engine operating conditions change. The fuel distribution method may be carried out by using, for example, a low bandwidth closed-loop fuel re-distribution scheme or an open-loop fuel re-distribution scheme based on external parameters such as the flight conditions or other engine variables. The necessary speed of the fuel re-distribution will be dependent upon and will be a function of the timescale of changes in the engine operating conditions.

The adaptive scheduling varies the fuel re-distribution depending on the desired amount of damping augmentation at a particular operating condition. For example, during engine operating conditions where thermoacoustic instabilities do not occur, no damping augmentation is needed and the fuel profile within combustion chamber 19 should be substantially uniform. However, as the desired amount of damping changes based upon changes in operating conditions, the adaptive fuel re-distribution method may be configured to provide the necessary amount of damping to take into account the changed conditions. Thus, because the fuel re-distribution is operational only when required and only by the necessary amount, the engine will have increased durability.

Figure 7:
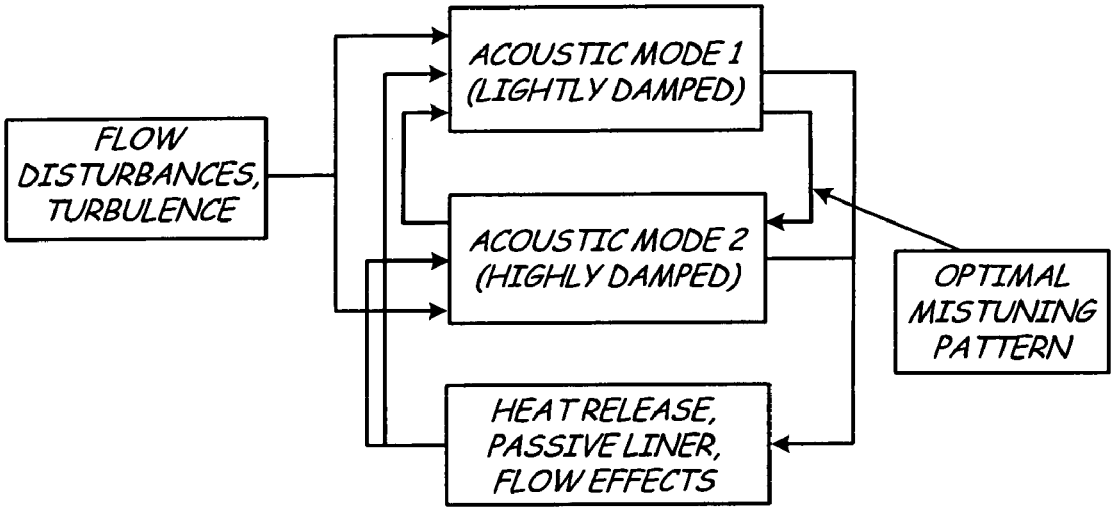
FIG. 7 is a block diagram of a thermoacoustic model illustrating the feedback connections produced by non-uniformities in fuel distribution within a combustion chamber.

FIG. 7 is a modified version of thermoacoustic model 50 shown and described above in FIG. 4 illustrating the feedback connections produced by wave speed mistuning, which results from spatial non-uniformities of fuel distribution within combustion chamber 19. Similar to thermoacoustic model 50, the combustion process creates flow disturbances and turbulence, which interact with the acoustics of combustion chamber 19 and results in a lightly damped acoustic mode (Mode 1) and a highly damped acoustic mode (Mode 2). Heat release feedback again interacts with the two acoustic modes, resulting in skew-symmetric feedback as discussed above. However, applying the fuel distribution method of the present invention, a sound speed mistuning pattern caused by a non-uniform temperature distribution within combustion chamber 19 creates a beneficial energy exchange feedback loop between the lightly damped and highly damped acoustic modes. As discussed previously, for nT-mode suppression, the optimal beneficial energy exchange between clockwise and counterclockwise wave modes results from a spatial fuel distribution pattern that has a 2 nT-mode shape.

Figure 8:
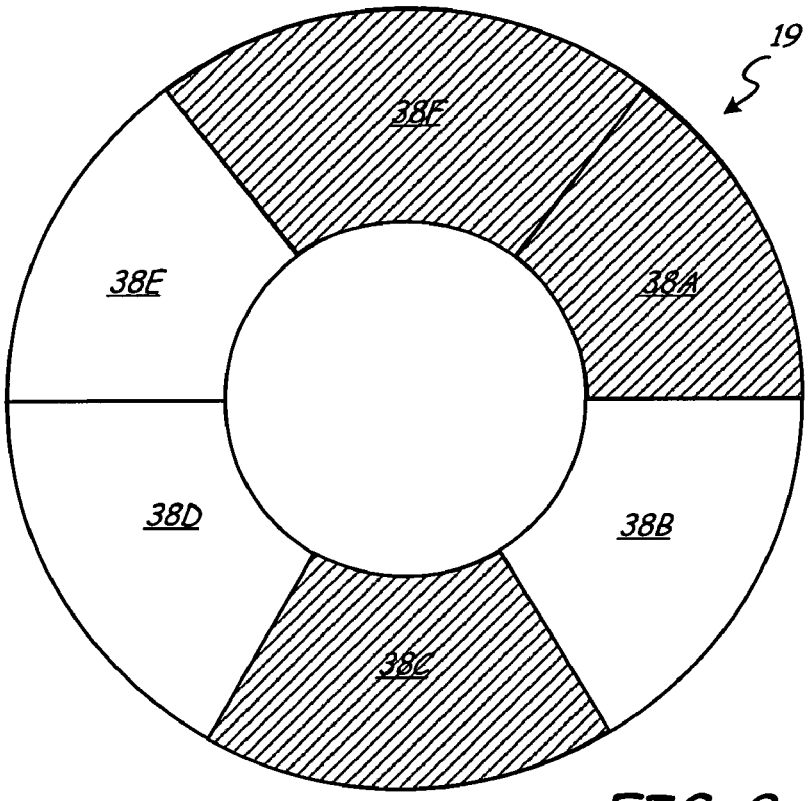
FIG. 8 illustrates one embodiment of a fuel mal-distribution pattern in the combustion chamber.

FIG. 8 generically illustrates a fuel mal-distribution pattern in combustion chamber 19 in accordance with the present invention. As discussed above in reference to FIG. 3, combustion chamber 19 includes chamber sections 38A-38F. For purposes of example, it is assumed that all six chamber sections are nearly identical, and that each section contains three swirl stabilized flames corresponding to the three fuel nozzles within each section. Furthermore, it is assumed that each of the chamber sections 38A-38F are spatially connected and allow the passage of acoustic waves throughout combustion chamber 19. As discussed previously, the thermoacoustic instabilities arise on account of the skew-symmetry in the heat release feedback, as described in reference to FIG. 4. In particular, the skew-symmetry is a direct result of the local asymmetry of the swirlers located within combustion chamber 19.

Stability augmentation of the thermoacoustic instabilities within combustion chamber 19 may be achieved by the circumferential mal-distribution of fuel flow to each of chamber sections 38A-38F. In particular, stability of the spinning waves within combustion chamber 19 may be achieved by scheduling fuel flow to each chamber section as a function of total fuel flow. In this example, in order to exchange energy between the +1 tangential spinning wave mode and the −1 tangential spinning wave mode, a $2^{nd}$ harmonic pattern is utilized as described previously. This $2^{nd}$ harmonic pattern is approximated by the six section patterns shown in FIG. 8. As shown in FIG. 8, chamber sections 38A, 38C, and 38F receive more than the mean section fuel flow, whereas chamber sections 38B, 38D, and 38E receive correspondingly less. This fuel distribution pattern produces a non-uniform mean temperature distribution, which effectively produces a non-uniform wave speed within combustion chamber 19 based upon the relationship between temperature and wave speed discussed above. The magnitude of the temperature mal-distribution will determine its effectiveness in reducing thermoacoustic instabilities, as will be illustrated in the following figure.

Figure 9:
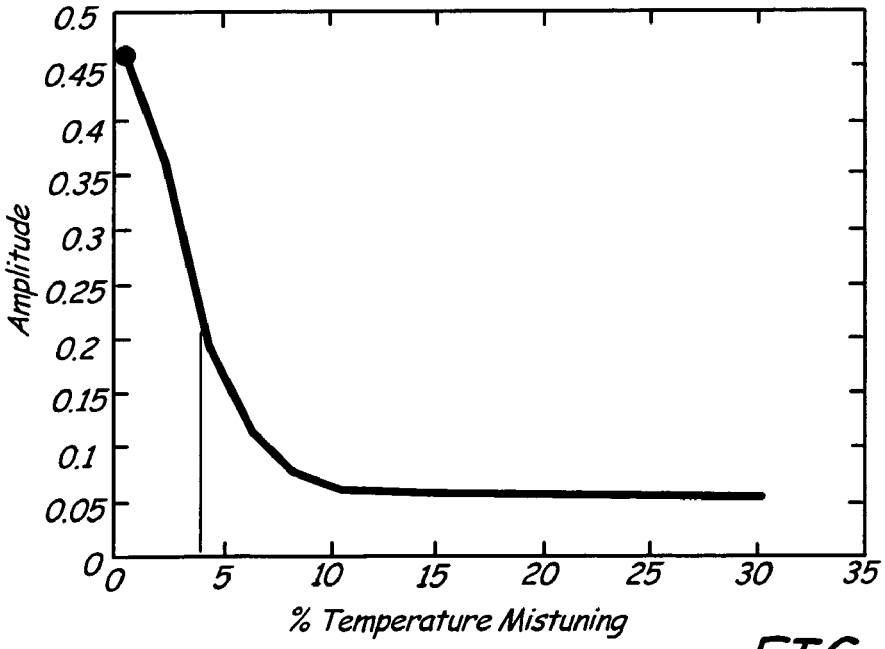
FIG. 9 is a graph illustrating effectiveness in reducing thermoacoustic instabilities as a function of the magnitude of temperature mal-distribution.

FIG. 9 is a graph illustrating effectiveness in reducing thermoacoustic instabilities as a function of the magnitude of the temperature mal-distribution. In general, the greater the number on the "Amplitude" axis the greater the level of pressure oscillations of the +1 and −1 spinning wave modes, which results in a combustion system that is nosier and more unstable. Furthermore, the greater the number on the "% Temperature Mistuning" axis the greater the difference between the various "hot" and "cold" chamber sections.

As shown in FIG. 9, when there is a uniform temperature distribution within combustion chamber 19 (0% temperature mistuning), the system reaches its highest level of noise and instability. As the temperature distribution within combustion chamber 19 becomes non-uniform, amplitude first rapidly decreases, and then begins to level out at about 10% temperature mistuning. In fact, when dealing with a 2 nT-harmonic pattern such as the example used throughout this disclosure, any circumferential fuel re-distribution pattern greater than about 4% of the mean circumferential fuel flow rate will have noticeable beneficial effect on stability of the spinning wave modes.

As shown in FIG. 9, any temperature mistuning up to about 10% will result in an effect on eigenvalues similar to that described above in reference to FIG. 6A. However, any temperature mistuning over about 10% will result in an effect similar to that described above in reference to FIG. 6B. Therefore, in this particular example involving a combustion chamber having six separately-fueled chamber sections, the "optimal" amount of fuel mal-distribution is about 10%. However, it should be understood that the preceding example is only one such example of controlling thermoacoustic instabilities according to the present invention, and is presented for purposes of explanation and not for limitation. Therefore, the "optimal" amount of fuel mal-distribution may be greater than or less than 10% depending upon the average fuel to air ratio in the combustion chamber.

Although the method of the present invention has been described above as utilizing a flow divider valve to distribute controlled amounts of fuel to combustor 10, embodiments that do not utilize a flow divider valve are also contemplated and within the intended scope of the present invention.

A first alternative to utilizing a flow divider valve is to design fuel nozzles 17 with different flow capacities. In particular, each of fuel zones 36A-36F may be designated a "richer" fuel zone or a "leaner" fuel zone. At a particular fuel flow rate, the richer fuel zones would receive more fuel than the leaner fuel zones. As a result, the corresponding "richer" combustion chamber sections would be hotter, while the "leaner" combustion chamber sections would be cooler, thus creating a non-uniform temperature distribution within the combustion chamber. One way to create a "richer" fuel zone is to enlarge the apertures in the fuel nozzles to increase the amount of fuel the nozzle will discharge at a particular flow rate. Similarly, one way to create a "leaner" fuel zone is to decrease the size of the apertures in the fuel nozzles to decrease the amount of fuel that the nozzle will discharge. Furthermore, these fuel nozzles could be designed to provide variable fuel uniformity as a function of fuel flow rate if a staged fuel system is used. For example, each fuel nozzle may be designed with first and second fuel circuits for providing fuel to the nozzle. Below a predetermined fuel flow rate, only the first fuel circuits would provide fuel to their respective nozzles, creating a non-uniform fuel distribution (and thus, a non-uniform temperature distribution) within the combustion chamber. However, above the predetermined flow rate, both the first and second fuel circuits would provide fuel to their respective nozzles, creating a flow of fuel through each nozzle that is substantially equivalent. As a result, there would be a substantially uniform temperature distribution within the combustor.

A second alternative to a flow divider valve is to utilize individual valves within each fuel nozzle 17 or fuel zones 36A-36F. Each valve may be designed to change from a "closed" position (where no flow reaches the nozzles) to an "open" position (where all or part of the stream of fuel reaches the nozzles) at a predetermined fuel flow rate, thus providing variable temperature non-uniformity within the combustion chamber.

A third alternative to a flow divider valve is to utilize fuel nozzles 17 having "fixed orifices." In general, nozzles having fixed orifices would provide a fixed non-uniformity between the fuel zones at all fuel flow rates. Thus, unlike flow divider valve 30 discussed above, fixed orifice nozzles create a non-uniform temperature distribution over approximately the entire range of engine operating conditions unless a device capable of creating variable flow with fixed orifice nozzles is incorporated into the system.

Although the discussion above focused on controlling a temperature distribution within a combustion chamber by controlling the amount of fuel distributed to a plurality of fuel nozzles (or fuel zones), the temperature distribution may alternatively be controlled by controlling the amount of air distributed to the combustion chamber. In particular, the temperature of a combustion chamber section depends upon the fuel to air (f/a) ratio in its associated fuel zone. As discussed above, chamber sections associated with "richer" fuel zones are generally hotter than chamber sections associated with "leaner" fuel zones. A "richer" fuel zone may be created by distributing a fixed amount of air and increasing fuel flow to the zone, distributing a fixed amount of fuel and decreasing air flow to the zone, or increasing the fuel distributed to the fuel zone while decreasing the air flow. Similarly, a "leaner" fuel zone may be created by distributing a fixed amount of air and decreasing fuel flow to the zone, distributing a fixed amount of fuel and increasing air flow to the zone, or decreasing fuel distributed to the fuel zone while increasing the air flow. As can be seen from these examples, a non-uniform temperature distribution may be created in a combustion chamber by varying fuel flow, air flow, or both.

Figure 10:
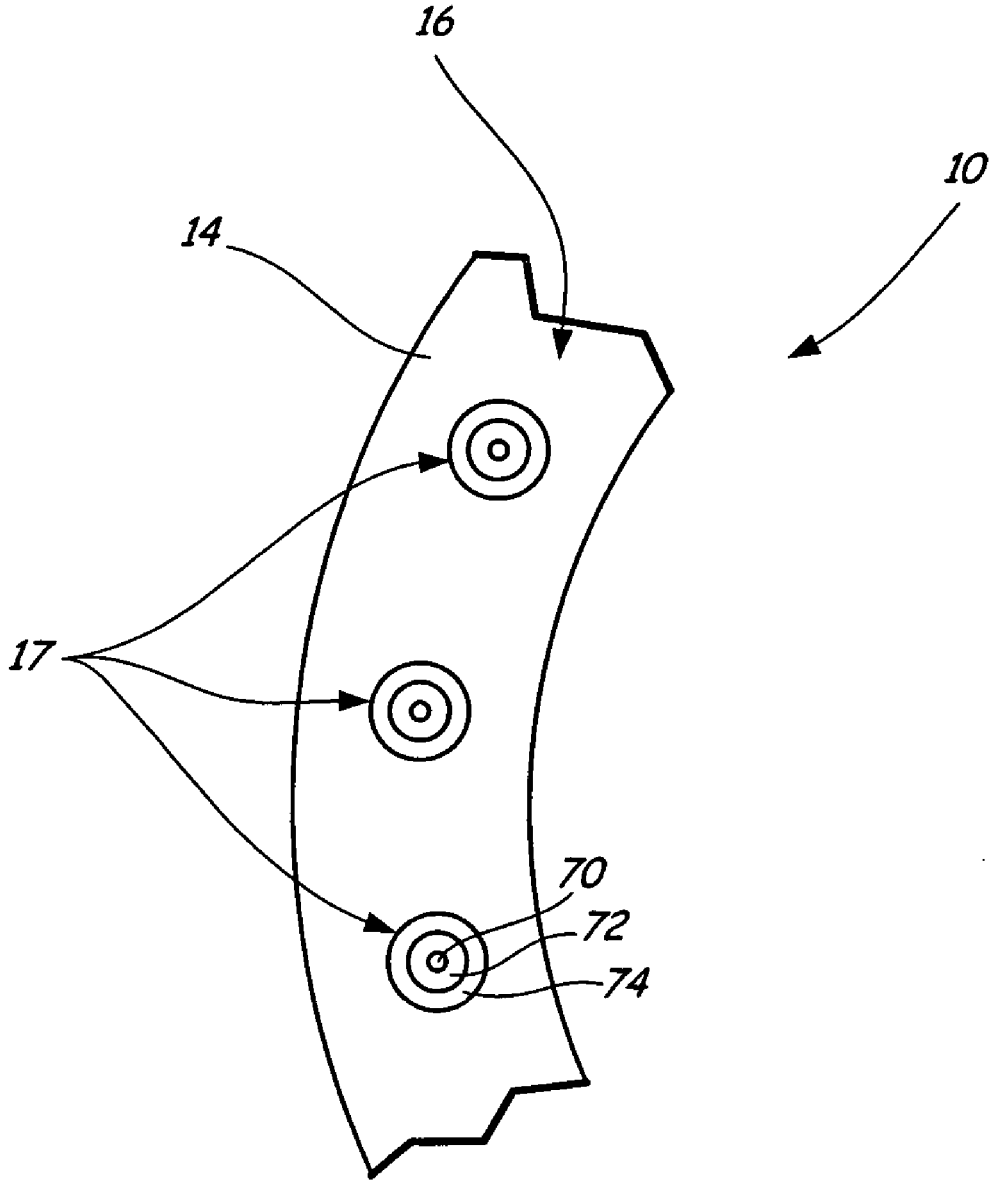
FIG. 10 is a diagram illustrating an enlarged view of a section of the combustor illustrated in FIG. 1.

One method for varying the amount of combustion air flowing into combustion chamber 19 involves designing fuel nozzle air swirlers with different flow capacities. FIG. 10 is a diagram illustrating a cut-out section of combustor 10 shown and described above in reference to FIG. 1. As shown in FIG. 10, fuel nozzle 17 includes inner air swirler 70, fuel injector portion 72, and outer air swirler 74. Inner and outer air swirlers 70 and 74 are designed to provide combustion air to chamber sections 38A-38F and meter the fuel to air ratio in the primary combustion zone at the front of combustion chamber 19. In one embodiment, inner air swirler 70 is a cylindrical passage having a plurality of vane members configured to provide a "swirling air" source on the inside of fuel injector portion 72, while outer air swirler 74 is an annular-shaped passage having a plurality of vane members configured to provide a "swirling air" source on the outside of fuel injector portion 72. The swirling air distributed through inner and outer air swirlers 70 and 74 creates a shear force on the fuel, which is injected through annular-shaped fuel injector portion 72 between inner and outer air swirlers 70 and 74. Inner and outer air swirlers 70 and 74 not only provide a source of "combustion air" within combustion chamber 19, but they also act to break up the fuel injected through fuel portion 72 into droplets to enhance the combustion process. It is important to note that nozzle 17 is shown merely for purposes of example and not for limitation, and that other types of nozzles and air swirlers are also contemplated.

Various nozzles 17 attached to fuel manifold assembly 16 may be designed such that, at the same pressure drop, their inner and outer air swirlers 70 and 74 provide different air flow rates into combustion chamber 19. In one embodiment, each set of nozzles 17 in fuel zones 36A-36F are designed to provide different air flow rates to create a non-uniform air flow distribution within combustion chamber 19. As discussed above, a non-uniform air flow distribution affects the temperature distribution within combustion chamber 19 in the same manner as a non-uniform fuel flow distribution. Thus, it is possible to achieve a non-uniform temperature distribution within combustion chamber 19 (and thus, control thermoacoustic instabilities) by varying the amount of combustion air distributed into combustion chamber 19.

Figure 11A:
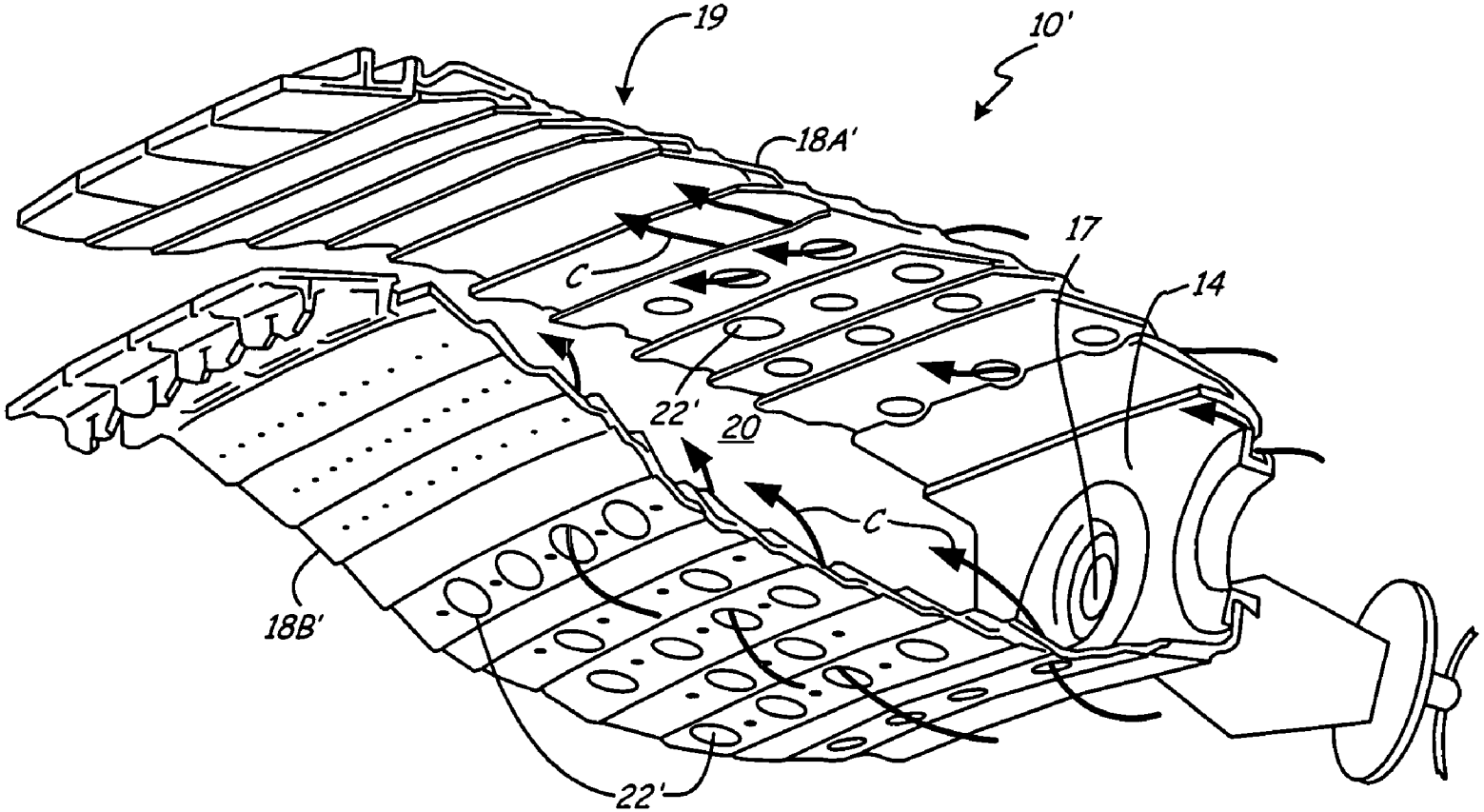
FIG. 11A is a cross-sectional view of a first alternative combustor.
Figure 11B:
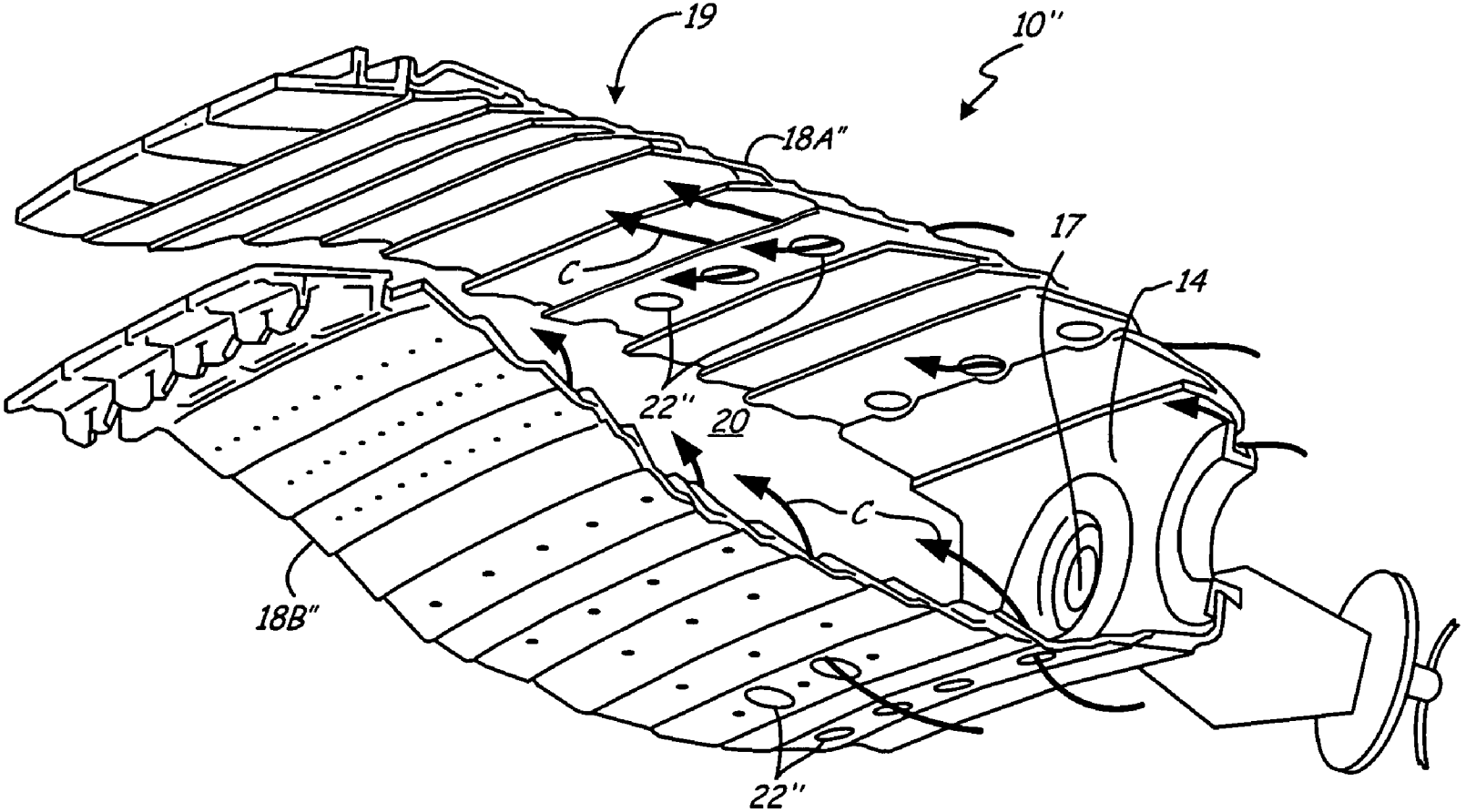
FIG. 11B is a cross-sectional view of a second alternative combustor.

Another method for varying the amount of combustion air flowing into combustion chamber 19 involves varying the "quench" air flow into combustion chamber 19. In this disclosure, "quench" air is the combustion air flow distributed into a combustion chamber through the air holes in the outer and inner chamber sections. For example, some fuel zones may be designed with a greater number of air holes or holes with larger diameters to provide increased air flow into the combustion chamber sections that are preferably cooler. This type of design is illustrated in FIG. 11A. In particular, FIG. 11A is a cross-sectional view of combustor 10', which is similar to combustor 10 illustrated in FIG. 2 except that outer chamber section 18A' and inner chamber section 18B' each have a greater number of holes 22'. A greater number of air holes 22' results in an overall increase in combustion air flow into combustion chamber 19, which leads to a decrease in chamber temperature. Other fuel zones may be designed with fewer holes or holes with smaller diameters to provide decreased air flow into combustion chamber sections that are preferably hotter. This type of design is illustrated in FIG. 11B. In particular, FIG. 11B is a cross-sectional view of combustor 10", which is similar to combustor 10 illustrated in FIG. 2 except that outer chamber section 18A" and inner chamber section 18B" each have a fewer number of holes 22". Fewer air holes 22" results in an overall decrease in combustion air flow into combustion chamber 19, which leads to an increase in local chamber temperature.

It should be understood that other methods for varying air flow into a combustion chamber to create a non-uniform temperature distribution that are consistent with the above disclosure are also contemplated. Furthermore, although the above methods for varying the amount of combustion air create "fixed" temperature non-uniformities, methods that allow the non-uniform temperature distribution to transform into a substantially uniform temperature distribution at certain operating conditions are also within the intended scope of the present invention.

The present invention is a method for shaping mean combustor temperature in order to increase dynamic stability within the combustor. The method adaptively re-distributes the amount of fuel or air circumferentially within the combustor in an optimal pattern to cause beneficial energy exchange between various acoustic modes. The specific, optimal pattern will depend upon the shape of the thermoacoustic wave modes the method is attempting to control. In particular, the methodology of the present invention offers a means whereby more stable modes may be used to augment the damping of their less stable counterparts. Furthermore, the method may be configured to ensure that the fuel or air redistribution is operational only when required as well as only to the extent necessary.

The method exploits the modal structure of the combustion instabilities and thus enjoys several benefits including, but not limited to: (1) It is applicable to general combustion schemes including both swirl and bluff-body schemes; (2) The method does not require physics-based dynamic models for unsteady heat release response; (3) The approach is robust enough to handle many un-modeled physical effects, such as changes in frequency, as long as the modal structure of the thermoacoustic instability is approximately preserved; (4) The quantitative amount of mistuning necessary for stabilization of the thermoacoustic instabilities depends only upon the mean flow effects such as combustion chamber temperature; and (5) The method may be configured to operate only over a small portion of engine operating conditions where the thermoacoustic instability is present so that turbine durability and engine thrust are not compromised at most of the engine operating conditions.

Although the present invention has been described with reference to preferred embodiments, workers skilled in the art will recognize that changes may be made in form and detail without departing from the spirit and scope of the invention.

The invention claimed is:

1. A method for controlling temperature distributions within a combustor comprising, the combustor having a plurality of circumferentially positioned chamber sections therein, controlling fuel-to-air ratios in fuel flows and air flows supplied to each of the chamber sections, the plurality of chamber sections having among them a sequence of chamber sections successively positioned in the combustor with an end chamber section at each end of the sequence, the end chamber sections having fuel-to-air ratios that are larger than the fuel-to-air ratios of two further chamber sections, wherein each of the two further chamber sections are supplied with fuel and air and are positioned in the combustor adjacent to a corresponding one of the two opposite end chamber sections in the sequence of successively positioned chamber sections;

and wherein the two further chamber sections have at least one additional chamber section from the plurality of chamber sections positioned between them in the combustor, the additional chamber section having a fuel-to-air ratio that is larger than the fuel-to-air ratio of the two further chamber sections.

2. The method of claim 1, wherein the difference in the fuel-to-air ratios in the two chamber sections is a function of the total fuel flow to all of the chamber sections in the plurality thereof during combustion of fuel therein.

3. The method of claim 1, wherein the difference in the fuel-to-air ratios in the two chamber sections is a function of the total fuel flow through all of the fuel zones during combustion of fuel in the plurality of chamber sections.

4. The method of claim 1, wherein controlling the fuel-to-air ratios comprises distributing controlled amounts of air to the chamber sections.

5. The method of claim 4, wherein the combustor includes a plurality of air swirlers configured to distribute the controlled amounts of air to the chamber sections.

6. The method of claim 4, further comprising adjusting the controlled amounts of air distributed to the chamber sections as a function of engine speed.

7. The method of claim 1, wherein controlling the fuel-to-air ratios comprises distributing controlled amounts of fuel to the chamber sections.

8. The method of claim 7, wherein distributing controlled amounts of fuel to the chamber sections comprises dividing the controlled amounts of fuel in a flow divider valve.

9. The method of claim 8, further comprising adjusting the controlled amounts of fuel distributed to the chamber sections as a function of a total fuel flow rate into the flow divider valve.

10. The method of claim 9, wherein controlling the fuel-to-air ratios comprises creating a non-uniform temperature distribution within the combustor.

11. The method of claim 10, further comprising transforming the non-uniform temperature distribution into a substantially uniform temperature distribution above a particular value of the total fuel flow rate.

12. A method for controlling a combustor having a plurality of circumferentially positioned chamber sections, the method comprising:

creating a non-uniform temperature distribution within the combustor by controlling fuel-to-air ratios in fuel flows and air flows supplied to each of the plurality of chamber sections, the plurality of chamber sections having among them a sequence of chamber sections successively positioned in the combustor with an end chamber section at each end of the sequence, the end chamber sections having fuel-to-air ratios that are larger than the fuel-to-air ratios of two further chamber sections, wherein each of the two further chamber sections are supplied with fuel and air and are positioned in the combustor adjacent to a corresponding one of the two opposite end chamber sections in the sequence of successively positioned chamber sections;

wherein the two further chamber sections have at least one additional chamber section from the plurality of chamber sections positioned between them in the combustor, the additional chamber section having a fuel-to-air ratio that is larger than the fuel-to-air ratio of the two further chamber sections.

13. The method of claim 12, wherein controlling the fuel-to-air ratios comprises distributing controlled amounts of fuel to the chamber sections to create the non-uniform temperature distribution.

14. The method of claim 12, wherein controlling the fuel-to-air ratios comprises distributing controlled amounts of air to the chamber sections to create the non-uniform temperature distribution.

15. The method of claim 14, wherein the combustor includes a plurality of air swirlers configured to distribute the controlled amounts of air to the chamber sections.

16. The method of claim 14, further comprising adjusting the controlled amounts of air distributed to the chamber sections as a function of engine speed.

17. A method for controlling a combustor having a plurality of circumferentially positioned chamber sections, the method comprising:

dividing fuel from a fuel source in a flow divider valve;

distributing controlled amounts of the fuel from the flow divider valve to the plurality of chamber sections in a non-uniform fuel pattern;

distributing controlled amounts of air to the plurality of chamber sections; and controlling fuel-to-air ratios in the fuel and air distributed to each of the chamber sections, the plurality of chamber sections having among them a sequence of chamber sections successively positioned in the combustor with an end chamber section at each end of the sequence, the end chamber sections having fuel-to-air ratios that are larger than the fuel-to-air ratios of two further chamber sections, wherein each of the two further chamber sections are supplied with fuel and air and are positioned in the combustor adjacent to a corresponding one of the two opposite end chamber sections in the sequence of successively positioned chamber sections;

wherein the two further chamber sections have at least one additional chamber section from the plurality of chamber sections positioned between them in the combustor, the additional chamber section having a fuel-to-air ratio that is larger than the fuel-to-air ratio of the two further chamber sections.

18. The method of claim 17, wherein the non-uniform fuel pattern reduces thermoacoustic instabilities in the combustor by counteracting the effect of heat release feedback.

19. The method of claim 17, wherein the non-uniform fuel pattern results in a non-uniform temperature distribution within the combustor.

20. The method of claim 17, further comprising adjusting the controlled amounts of fuel distributed to the chamber sections as a function of a total fuel flow rate into the flow divider valve.

21. The method of claim 20, further comprising transforming the non-uniform fuel pattern into a substantially uniform fuel pattern above a particular value of the total fuel flow rate.

22. The method of claim 17, wherein the combustor comprises an annular combustor.

23. The method of claim 22, wherein the annular combustor comprises a swirl stabilized annular combustor.

24. The method of claim 17, wherein the combustor comprises a cylindrical combustor.

* * * * *